US006482513B1

(12) United States Patent
Hayes

(10) Patent No.: US 6,482,513 B1
(45) Date of Patent: Nov. 19, 2002

(54) BRANCHED POLY(ETHYLENE TEREPHTHALATE) MONOFILAMENTS

(75) Inventor: Richard Allen Hayes, Brentwood, TN (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 09/927,704

(22) Filed: Aug. 10, 2001

(51) Int. Cl.[7] ..... D02G 3/00

(52) U.S. Cl. ..... 428/364; 528/298; 528/300; 528/301; 528/302; 528/307; 528/308; 528/308.6; 525/440; 525/443; 525/445; 525/540; 525/437; 428/397; 524/195; 264/176.1

(58) Field of Search ..... 528/298, 300, 528/301, 302, 307, 308, 308.6; 525/437, 440, 443, 540, 445; 428/364, 397; 524/195; 264/176.1

(56) References Cited

U.S. PATENT DOCUMENTS

| | | | | |
|---|---|---|---|---|
| 5,378,537 A | | 1/1995 | Masuda et al. | |
| 5,686,552 A | | 11/1997 | Masuda et al. | |
| 6,139,954 A | * | 10/2000 | Dean et al. | 428/221 |

FOREIGN PATENT DOCUMENTS

| | | |
|---|---|---|
| JP | 59-094616 | 6/1984 |

* cited by examiner

*Primary Examiner*—Samuel A. Acquah
(74) *Attorney, Agent, or Firm*—Craig Evans

(57) ABSTRACT

A monofilament comprising a branched poly(ethylene terephthalate) having an inherent viscosity of at least 0.50 dL/g. Also provided is a process for forming a monofilament that comprises forming a branched poly(ethylene terephthalate) having an inherent viscosity of at least 0.50 dL/g and shaping the branched poly(ethylene terephthalate) to form the monofilament.

23 Claims, No Drawings

BRANCHED POLY(ETHYLENE TEREPHTHALATE) MONOFILAMENTS

BACKGROUND OF THE INVENTION

The present invention relates to monofilaments. More specifically, the invention relates to monofilaments produced from branched poly(ethylene terephthalate)s.

Polymeric monofilaments have found use as reinforcements for rubbers, fishing lines, toothbrush bristles, paint brush bristles and the like. In addition, woven fabrics produced from monofilaments have found use as industrial belts and paper machine clothing.

Polyesters have generally been taught to be useful as monofilaments. Polyester monofilaments are used due to their high strength and good dimensional stability. For example, U.S. Pat. Nos. 3,051,212 and 3,869,427 teach the use of polyester monofilaments as reinforcements for rubber articles. The use of polyester monofilaments to make fabric for processing and drying wet pulp to make paper is described in U.S. Pat. Nos. 3,858,623, 4,071,050, 4,374,960, 5,169,499, 5,169,711, 5,283,110, 5,297,590, 5,635,298, 5,692,938, and 5,885,709, and Kirk-Othmer Encyclopedia of Chemical Technology ($2^{nd}$ Ed.) (Interscience) 1967, Vol. 14, pp. 503–508 and the references cited therein.

Linear poly(ethylene terephthalate)s having inherent viscosities between 0.60 and 1.0 dL/g have typically been taught within the background art as useful in the production of monofilaments. Generally, it has been taught the inherent viscosity is greater than 0.70 dL/g. U.S. Pat. Nos. 3,051,212, 3,627,867, 3,657,191, 3,869,427, 3,959,215, 3,959,228, 3,975,329, 4,016,142, 4,017,463, 4,139,521, 4,374,960, 5,472,780, 5,635,298, 5,763,538, and 5,885,709 teach the use of high molecular weight, linear polyesters for use in the manufacture of monofilaments. To achieve poly(ethylene terephthalate) inherent viscosities of 0.70 or greater, additional processes must be undertaken. One process to achieve said inherent viscosity of 0.70 or greater is to increase the melt finishing time, typically through the use of two finishers. An example of this is taught within U.S. Pat. No. 4,139,521. However, the increased time in the melt allows the resultant polyester to degrade and discolor. Another process taught within the art to achieve the desired inherent viscosity of 0.70 or greater which avoids this polyester discoloration is solid phase polymerization (SSP). Generally this process involves heating poly(ethylene terephthalate) pellets to temperatures in excess of about 225° C. either under an inert gas purge or under vacuum for extended lengths of time. U.S. Pat. Nos. 3,051,212, 3,657,191, and 5,635,298 teach the use of solid state polymerization to increase the inherent viscosity of polyesters for use in the production of monofilaments.

Occasionally, general reference has suggested the use of branched polyesters for use as monofilaments. For example, U.S. Pat. No. 5,378,537 discloses a polyester monofilament comprising 0.005 to 1.5 weight percent of a carbodiimide and 0.01 to 30 weight percent of a random copolymer having tetrafluoroethylene and ethylene as main components. At column 2, lines 54–58, this references states that, "It is permissible to use an addition of a small amount of a chain-branching agent such as pentaerythritol, trimethylol propane, trimellitic acid, trimesic acid, or boric acid." However, U.S. Pat. No. 5,378,537 only exemplifies the use of a linear poly(ethylene terephthalate) with an inherent viscosity of 0.93 dL/g.

As a further example, U.S. Pat. No. 5,686,552 discloses a polyester composition consisting of 99.8 to 60 weight percent of a polyester, 0.2 to 40 weight percent of a thermoplastic polymer which is not a reaction product of a dicarboxylic acid and a glycol and which contains no fluorine atoms, and 0.005 to 1.5 weight percent of an unreacted carbodiimide compound. This reference further teaches that said polyester "may also be combined with a small amount of a chain-branching agent such as pentaerythritol, trimethylol propane, trimellitic acid, or boric acid" (column 3, lines 49–51) and that "The limiting viscosity of the polyester is normally at least 0.6, and it is preferably at least 0.7 for particularly superior strength." (column 3, line 66, through column 4, line 1). However, in the 230 examples disclosed therein, U.S. Pat. No. 5,686,552 consistently utilizes a linear poly(ethylene terephthalate) with an inherent viscosity of 0.94 dl/g.

As yet a further example, Pat. Abstracts of Japan publication number 59-094616 discloses monofilaments spun from a butylene terephthalate copolymer containing 3 to 30 weight percent branched alkylene terephthalate units or blends containing butylene terephthalate homopolymer and a branched alkylene terephthalate polymer and having an intrinsic viscosity greater than 1.1 dl/g.

For many end uses, the monofilaments require hydrolysis resistance. It has been taught within the art that lowered levels of carboxyl endgroups enhance the hydrolysis resistance of the as formed polyester monofilaments. For example, see the discussions in U.S. Pat. Nos. 3,051,212, 3,657,191, 4,139,521, 4,374,961, 5,246,992, 5,378,537 and the references cited therein.

Hydrolysis stabilization additives have been taught within the art. Generally, said hydrolysis stabilization additives have been taught to function by reacting with free polymeric carboxyl endgroups. U.S. Pat. Nos. 3,051,212 and 4,374,960 teach the use of diazomethane to "cap" the polyester carboxyl endgroups to enhance the hydrolysis resistance.

Carbodiimides are taught as polyester hydrolysis stabilization additives in U.S. Pat. Nos. 3,193,522, 3,193,523, 3,975,329, 5,169,499, 5,169,711, 5,246,992, 5,378,537, 5,464,890, 5,686,552, 5,763,538, 5,885,709 and 5,886,088. Epoxides are taught as polyester hydrolysis stabilization additives in U.S. Pat. Nos. 3,627,867, 3,657,191, 3,869,427, 4,016,142, 4,071,504, 4,139,521, 4,144,285, 4,374,960, 4,520,174, 4,520,175, and 5,763,538. Cyclic carbonates, such as ethylene carbonate, are disclosed as hydrolysis stabilization additives in U.S. Pat. Nos. 3,657,191, 4,374,960, and 4,374,961. U.S. Pat. No. 3,959,215 teaches the use of phenylene bisoxazolines for the stabilization of polyesters. Aziridine compounds have been disclosed in the production of low carboxyl polyesters in U.S. Pat. Nos. 3,959,228 and 5,763,538. U.S. Pat. No. 5,763,538 teaches the use of keteneimines and isocyanates as polyester monofilament hydrolysis stabilization additives.

A shortcoming found in the background art is the need for additional polymerization processes to achieve high molecular weight polyesters with inherent viscosities of 0.70 dL/g or greater to provide the desired high strength monofilaments. The present invention avoids said additional polymerization processes while providing adequate monofilament strengths.

BRIEF SUMMARY OF THE INVENTION

The present invention provides monofilaments comprising branched poly(ethylene terephthalate)s having an inherent viscosity of at least 0.5 dL/g. In one embodiment, the branched poly(ethylene terephthalate)s incorporate 0.01 to 1.0 mole percent of a polyfunctional branching agent and may optionally incorporate up to 5 mole percent of other diols and up to 5 mole percent of other dicarboxylic acids. In another embodiment, the branched poly(ethylene terephthalate)s have an inherent viscosity in the range of about 0.50 to 0.70 dL/g, preferably in the range of about 0.60 to 0.70 dL/g.

A further aspect of the present invention is branched poly(ethylene terephthalate)s stabilized with an effective amount of hydrolysis stabilization additive shaped in the form of monofilaments. Said hydrolysis stabilization additive chemically reacts with the carboxylic acid endgroups and is preferably carbodiimides.

A further aspect of the present invention is blends of branched poly(ethylene terephthalate)s with a polymer shaped in the form of monofilaments. The present invention is also provides blends of branched poly(ethylene terephthalate)s with other linear polyesters shaped in the form of monofilaments. Said other linear polyesters may be produced from dicarboxylic acids and diols. Further, the present invention provides blends of branched poly(ethylene terephthalate)s, linear polyesters, and polymers shaped in the form of monofilaments.

A further aspect of the present invention is blends of branched poly(ethylene terephthalate)s with other linear polyesters stabilized with an effective amount of hydrolysis stabilization additive shaped in the form of monofilaments. The present invention also provides blends of branched poly(ethylene terephthalate)s, linear polyesters, and polymers stabilized with an effective amount of hydrolysis stabilization additive shaped in the form of monofilaments.

Also provided is a process for forming a monofilament, the process comprising the steps of (a) forming a branched poly(ethylene terephthalate) having an inherent viscosity of at least 0.50 dL/g and (b) shaping the branched poly (ethylene terephthalate) to form said monofilament.

DETAILED DESCRIPTION OF THE INVENTION

One aspect of the present invention is branched poly (ethylene terephthalate)s shaped in the form of monofilaments. Said branched poly(ethylene terephthalate)s are comprised essentially of:

- 44.0 to 50.0 mole percent of terephthalic acid or lower esters of terephthalic acid, for example, dimethyl terephthalate;
- 44.0 to 50 mole percent of ethylene glycol;
- 0.01 to 1.0 mole percent of a polyfunctional branching agent;
- 0 to 5.0 mole percent of an other dicarboxylic acid; and
- 0 to 5.0 mole percent of an other diol.

Said polyfunctional branching agent is meant to include any material with three or more carboxylic acid functions, hydroxy functions or a mixture thereof. The term "carboxylic acid functions" is meant to include carboxylic acids, lower alkyl esters of carboxylic acids, glycolate esters of carboxylic acids, and the like and mixtures thereof. Specific examples of the desirable polyfunctional branching agent component include 1,2,4-benzenetricarboxylic acid, (trimellitic acid), trimethyl-1,2,4-benzenetricarboxylate, tris (2-hyroxyethyl)-1,2,4-benzenetricarboxylate, trimethyl-1,2,4-benzenetricarboxylate, 1,2,4-benzenetricarboxylic anhydride, (trimellitic anhydride), 1,3,5-benzenetricarboxylic acid, 1,2,4,5-benzenetetracarboxylic acid, (pyromellitic acid), 1,2,4,5-benzenetetracarboxylic dianhydride, (pyromellitic anhydride), 3,3',4,4'-benzophenonetetracarboxylic dianhydride, 1,4,5,8-naphthalenetetracarboxylic dianhydride, citric acid, tetrahydrofuran-2,3,4,5-tetracarboxylic acid, 1,3,5-cyclohexanetricarboxylic acid, pentaerythritol, 2-(hydroxymethyl)-1,3-propanediol, 2,2-bis (hydroxymethyl)propionic acid, trimer acid, and the like and mixtures therefrom. This should not be considered limiting. Essentially any polyfunctional material which includes three or more carboxylic acid or hydroxyl functions may find use within the present invention.

Said other dicarboxylic acid component is meant to include unsubstituted and substituted aromatic, aliphatic, unsaturated, and alicyclic dicarboxylic acids and the lower alkyl esters of dicarboxylic acids having from 2 carbons to 36 carbons. Specific examples of the desirable dicarboxylic acid component include isophthalic acid, dimethyl isophthalate, 2,6-napthalene dicarboxylic acid, dimethyl-2,6-naphthalate, 2,7-naphthalenedicarboxylic acid, dimethyl-2,7-naphthalate, 3,4'-diphenyl ether dicarboxylic acid, dimethyl-3,4'diphenyl ether dicarboxylate, 4,4'-diphenyl ether dicarboxylic acid, dimethyl-4,4'-diphenyl ether dicarboxylate, 3,4'-diphenyl sulfide dicarboxylic acid, dimethyl-3,4'-diphenyl sulfide dicarboxylate, 4,4'-diphenyl sulfide dicarboxylic acid, dimethyl-4,4'-diphenyl sulfide dicarboxylate, 3,4'-diphenyl sulfone dicarboxylic acid, dimethyl-3,4'-diphenyl sulfone dicarboxylate, 4,4'-diphenyl sulfone dicarboxylic acid, dimethyl4,4'-diphenyl sulfone dicarboxylate, 3,4'-benzophenonedicarboxylic acid, dimethyl-3,4'-benzophenonedicarboxylate, 4,4'-benzophenonedicarboxylic acid, dimethyl-4,4'-benzophenonedicarboxylate, 1,4-naphthalene dicarboxylic acid, dimethyl-1,4-naphthalate, 4,4'-methylene bis(benzoic acid), dimethyl-4,4'-methylenebis(benzoate), oxalic acid, dimethyl oxalate, malonic acid, dimethyl malonate, succinic acid, dimethyl succinate, methylsuccinc acid, glutaric acid, dimethyl glutarate, 2-methylglutaric acid, 3-methylglutaric acid, adipic acid, dimethyl adipate, 3-methyladipic acid, 2,2,5,5-tetramethylhexanedioic acid, pimelic acid, suberic acid, azelaic acid, dimethyl azelate, sebacic acid, 1,11-undecanedicarboxylic acid, 1,10-decanedicarboxylic acid, undecanedioic acid, 1,12-dodecanedicarboxylic acid, hexadecanedioic acid, docosanedioic acid, tetracosanedioic acid, dimer acid, 1,4-cyclohexanedicarboxylic acid, dimethyl-1,4-cyclohexanedicarboxylate, 1,3-cyclohexanedicarboxylic acid, dimethyl-1,3-cyclohexanedicarboxylate, 1,1-cyclohexanediacetic acid, metal salts of 5-sulfodimethylisophalate, fumaric acid, maleic anhydride, maleic acid, hexahydrophthalic acid phthalic acid and the like and mixtures derived therefrom. This should not be considered limiting. Essentially any dicarboxylic acid known within the art may find utility within the present invention.

Said other diol component is meant to include unsubstituted, substituted, straight chain, branched, cyclic aliphatic, aliphatic-aromatic or aromatic diols having from 2 carbon atoms to 36 carbon atoms and poly(alkylene ether) glycols with molecular weights between about 250 to 4,000. Specific examples of the desirable other glycol component include 1,3-propanediol, 1,4-butanediol, 1,6-hexanediol, 1,8-octanediol, 1,10-decanediol, 1,12-dodecanediol, 1,14-tetradecanediol, 1,16-hexadecanediol, dimer diol, 4,8-bis (hydroxymethyl)-tricyclo[5.2.1.0/2.6]decane, 1,4-cyclohexanedimethanol, di(ethylene glycol), tri(ethylene glycol), poly(ethylene ether) glycols, poly(butylene ether) glycols and the like and mixtures derived therefrom. This should not be taken as limiting. Essentially any other diol known within the art may find use within the present invention.

The branched poly(ethylene terephthalate)s of the present invention need to have an inherent viscosity, which is an indicator of molecular weight in the range of about 0.50 to 0.70 dL/g. More desirably, the inherent viscosity, (IV), of said branched polyesters will be in the range of about 0.60 to 0.70 dL/g, as measured on a 0.5 percent (weight/volume) solution of the polyester in a 50:50 (weight) solution of trifluoroacetic acid:dichloromethane solvent system at room temperature. These inherent viscosities will be sufficient to produce the final branched polyester of the present invention for monofilaments. The polymerization conditions may be adjusted to obtain the desired inherent viscosities up to at least about 0.5 and desirably higher than 0.60 dL/g.

The branched poly(ethylene terephthalate)s of the present invention may be prepared by conventional polycondensation techniques. The product compositions may vary somewhat based on the method of preparation used, particularly in the amount of diol that is present within the polymer. These methods include the reaction of the diol monomers with acid chlorides. For example, acid chlorides of the dicarboxylic acid component may be combined with the diol component in a solvent, such as toluene, in the presence of a base, such as pyridine, which neutralizes the hydrochloric acid as it is produced. Such procedures are known. See, for example, R. Storbeck, et. al., in J. Appl. Polymer Science, Vol. 59, pp. 1199–1202 (1996). Other well known variations using acid chlorides may also be used, such as the interfacial polymerization method, or the monomers may simply be stirred together while heating.

When the polymer is made using acid chlorides, the ratio of the monomer units in the product polymer is about the same as the ratio of reacting monomers. Therefore, the ratio of monomers charged to the reactor is about the same as the desired ratio in the product. A stoichiometric equivalent of the diol components and the diacid components generally will be used to obtain a high molecular weight polymer.

Preferably, the branched poly(ethylene terephthalate)s of the present invention will be produced through a melt polymerization method. In the melt polymerization method, the dicarboxylic acid component, (either as acids, esters, or mixtures thereof), the diol component and the polyfunctional branching agent, are combined in the presence of a catalyst to a high enough temperature that the monomers combine to form esters and diesters, then oligomers, and finally polymers. The polymeric product at the end of the polymerization process is a molten product. Generally, the diol component is volatile and distills from the reactor as the polymerization proceeds. Such procedures are known. See, for example, U.S. Pat. Nos. 3,563,942, 3,948,859, 4,094,721, 4,104,262, 4,166,895, 4,252,940, 4,390,687, 4,419,507, 4,585,687, 5,053,482, 5,292,783, 5,446,079, 5,480,962, and 6,063,464 and the references cited therein, which are herein incorporated by reference.

The melt process conditions of the present invention, particularly the amounts of monomers used, depend on the polymer composition that is desired. The amount of the diol component, dicarboxylic acid component, and branching agent are desirably chosen so that the final polymeric product contains the desired amounts of the various monomer units, desirably with equimolar amounts of monomer units derived from the respective diol and diacid components. Because of the volatility of some of the monomers, especially some of the diol components, and depending on such variables as whether the reactor is sealed, (i.e., is under pressure), the polymerization temperature ramp rate, and the efficiency of the distillation columns used in synthesizing the polymer, some of the monomers may need to be included in excess at the beginning of the polymerization reaction and removed by distillation as the reaction proceeds. This is particularly true of the diol component.

The exact amount of monomers to be charged to a particular reactor is readily determined by a skilled practitioner, but often will be in the ranges below. Excesses of the diacid and diol are often desirably charged, and the excess diacid and diol is desirably removed by distillation or other means of evaporation as the polymerization reaction proceeds. The diol component is desirably charged at a level 0 to 100 percent greater than the desired incorporation level in the final product. For examples of the diol component which are volatile under the polymerization conditions, such as ethylene glycol, 1,3-propanediol, or 1,4-butanediol, 30 to 100 percent excesses are desirably charged. For less volatile examples of the diol component, such as dimer diol, no excesses need be desirably charged.

The ranges given for the monomers are very wide because of the wide variation in the monomer loss during polymerization, depending on the efficiency of distillation columns and other kinds of recovery and recycle systems and the like, and are only an approximation. Exact amounts of monomers that are charged to a specific reactor to achieve a specific composition are readily determined by a skilled practitioner.

In the polymerization process, the monomers are combined, and are heated gradually with mixing with a catalyst or catalyst mixture to a temperature in the range of 230° C. to about 300° C., desirably 250° C. to 295° C. The exact conditions and the catalysts depend on whether the diacids are polymerized as true acids or as dimethyl esters. The catalyst may be included initially with the reactants, and/or may be added one or more times to the mixture as it is heated. The catalyst used may be modified as the reaction proceeds. The heating and stirring are continued for a sufficient time and to a sufficient temperature, generally with removal by distillation of excess reactants, to yield a molten polymer having a high enough molecular weight to be suitable for the present invention.

Catalysts that may be used include salts of Li, Ca, Mg, Mn, Zn, Pb, Sb, Sn, Ge, and Ti, such as acetate salts and oxides, including glycol adducts, and Ti alkoxides. These are generally known in the art, and the specific catalyst or combination or sequence of catalysts used may be readily selected by a skilled practitioner. The preferred catalyst and preferred conditions differ depending on, for example, whether the diacid monomer is polymerized as the free diacid or as a dimethyl ester and the exact chemical identity of the diol component.

Polymers can be made by the melt condensation process above having adequate inherent viscosity for the present invention.

The branched poly(ethylene terephthalate)s of the present invention may incorporate additives, fillers, or other materials commonly taught within the art. Said additives may include thermal stabilizers, antioxidants, UV absorbers, UV stabilizers, processing aides, waxes, lubricants, color stabilizers, and the like. Said fillers may include calcium carbonate, glass, kaolin, talc, clay, carbon black, and the like. Said other materials may include nucleants, pigments, dyes, delusterants, such as titanium dioxide and zinc sulfide, antiblocks, such as silica, antistats, flame retardants, brighteners, silicon nitride, metal ion sequestrants, antistaining agents, silicone oil, surfactants, soil repellants, modifiers, viscosity modifiers, zirconium acid, reinforcing fibers, and the like. These additives, fillers, and other materials may be incorporated within the branched poly(ethylene terephthalate)s of the present invention through a separate melt compounding process utilizing any known intensive mixing process, such as extrusion, through intimate mixing with the solid granular material, such as pellet blending, or through cofeeding within the monofilament process.

The branched poly(ethylene terephthalate)s of the present invention may be blended with other polymers commonly taught within the art. Said other polymers may include polyolefins, such as polyethylene, polypropylene, polybutene, poly-4-methyl pentene, polystyrene, and the like, cyclic olefin polymers, modified polyolefins, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, thermoplastic polyurethanes, polyvinyl chloride, polyvinlidene chloride copolymers, liquid crystalline polymers, fluorinated polymers, such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and the like and combinations thereof. Polyester monofilaments which incorporate thermoplastic polyurethanes are taught in U.S. Pat. Nos. 5,169,711 and 5,652,057, said references are hereby incorporated in the present invention by reference. Polyester monofilaments which incorporate polyphenylene sulfide are taught in U.S. Pat. Nos. 5,218,043, 5,424,125, and 5,456,973, said references are incorporated in the present invention by reference. Polyester monofilaments which incorporate fluoropolymers are taught in U.S. Pat. Nos. 5,283,110, 5,297,590, 5,378,537, 5,407,736, 5,460,869, 5,472,780, 5,489,467, and 5,514,472, said references are incorporated in the present invention by reference. Polyester monofilaments which incorporate nonfluorine containing polymers are taught within U.S. Pat. No. 5,686,552, said reference which is hereby incorporated into the present invention by reference. Polyester monofilaments which incorporate liquid crystalline polymers are taught in U.S. Pat. No. 5,692,938, said reference which is hereby incorporated into the present invention by reference.

These other polymers may be incorporated within the branched poly(ethylene terephthalate)s of the present invention through a separate melt compounding process utilizing any known intensive mixing process, such as extrusion through a single or twin screw extruder, through intimate mixing with the solid granular material, such as mixing, stirring or pellet blending operations, or through cofeeding within the monofilament process.

The branched poly(ethylene terephthalate)s of the present invention may be formed into monofilaments by methods known within the art, for example, as taught in U.S. Pat. Nos. 3,051,212, 3,999,910, 4,024,698, 4,030,651, 4,072,457, and 4,072,663, which are herein incorporated into the present invention by reference. As one skilled in the art would appreciate, the process may be tailored to take into account the exact material to be formed into monofilaments, to take into account the desired physical and chemical properties desired in the monofilament and the like. The exact determination of the spinning parameters for achieving a certain combination of monofilament properties can be routinely carried out by determining the dependence of the contemplated monofilament property on the composition for the polyester and on the spinning parameters.

The branched poly(ethylene terephthalate)s of the present invention are preferably dried prior to their formation into monofilaments. In general, the branched poly(ethylene terephthalate)s of the present invention are melted at a temperature in the range of about 265 to about 300° C.

Preferably, the polyesters of the present invention are melted in the temperature range of about 265 to about 290° C. The spinning may generally be carried out by means of a spinning grid or an extruder. The extruder melts the dried granular polyester of the present invention and conveys the melt to the spinning aggregate by means of a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester may be filtered through, for example, screen filters, to remove any particulate foreign matter. The molten polyester may then be conveyed, optionally through a metering pump, through a die to form the monofilament. After exiting the die, the monofilaments may be quenched in an air or a water bath to form solid filaments. The monofilament may optionally be spin finished. These as made filaments may be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The finished cooled monofilaments may then be wound up onto spools. This should not be considered limiting. The branched poly(ethylene terephthalate)s of the present invention may be formed into the shape of monofilaments by any known process to produce monofilaments.

In order to provide the desired tenacity, the filaments prepared from the branched poly(ethylene terephthalate)s of the present invention may be drawn at least about 2:1. Preferably the filaments of the present invention may be drawn at least about 4:1. The overall draw ratio may be varied to allow for the production of a range of denier of the monofilaments.

Typical ranges of sizes of monofilaments used in press fabrics and dryer fabrics are 0.20 mm to 1.27 mm in diameter or the equivalent mass in cross-section in other cross-section shapes, such as square or oval. For forming fabrics, finer monofilaments are used, for example, as small as 0.05 mm to about 0.9 mm in diameter. Most often, the monofilaments used in forming fabrics have a diameter between about 0.12 mm to about 0.4 mm. On the other hand, for special industrial applications, monofilaments of 3.8 mm in diameter or greater may be desired.

The monofilament of the present invention may take any cross-sectional shape, for example, as a circle, flattened figure, square, triangle, pentagon, polygons, multifoil, dumbbell, cocoon, and the like. When this monofilament is intended as a warp in a papermaking drier canvas, the monofilament having the cross-sectional shape of a flattened figure is preferably used to improve the level of proof against staining and ensuring a flatness of the produced drier canvas. The term "flattened figure" as used herein refers to an ellipse or a rectangle. The term not only embraces a geometrically defined exact ellipse and rectangle but also shapes roughly similar to an ellipse and a rectangle and includes a shape obtained by rounding the four corners of a rectangle.

Fabrics of monofilaments may be formed into dryer screen fabrics by weaving the monofilament in both the machine and cross-machine directions.

A further aspect of the present invention is branched poly(ethylene terephthalate)s stabilized with an effective amount of hydrolysis stabilization additive shaped in the form of monofilaments. Said hydrolysis stabilization additive chemically reacts with the carboxylic acid endgroups and is preferably carbodiimides.

The hydrolysis stabilization additive may be any known material in the art which enhances the stability of the polyester monofilament to hydrolytic degradation. Examples of said hydrolysis stabilization additive may include: diazomethane, carbodiimides, epoxides, cyclic carbonates, oxazolines, aziridines, keteneimines, isocyanates, alkoxy end-capped polyalkylene glycols, and the like. This should not be considered limiting. Essentially any material which increases the hydrolytic stability of the monofilaments formed from the branched poly(ethylene terephthalate)s of the present invention would find utility as a hydrolysis stabilization additive in the present invention.

Specific examples of carbodiimides may be selected from the group consisting of N,N'-di-o-tolylcarbodiimide, N,N'-diphenylcarbodiimide, N,N'dioctyldecylcarbodiimide, N,N'-di-2,6-dimethylphenylcarbodiimide, N-tolyl-N'cyclohexylcarbodiimide, N,N'-di-2,6-diisopropylphenylcarbodiimide, N,N'di-2,6-di-tert.-butylphenylcarbodiimide, N-tolyl-N'-phenylcarbodiimide, N,N'-di-p-nitrophenylcarbodiimide, N,N'di-p-aminophenylcarbodiimide, N,N'di-p-hydroxyphenylcarbodiimide, N,N'-di-cyclohexylcarbodiimide, N,N'-di-p-tolylcarbodiimide, p-phenylene-bis-di-o-tolylcarbodiimide, p-phenylene-bisdicyclohexylcarbodiimide, hexamethylene-bisdicyclohexylcarbodiimide, ethylene-bisdiphenylcarbodiimide, benzene-2,4-diisocyanato-1,3,5-tris(1-methylethyl) homopolymer, a copolymer of 2,4-diisocyanato-1,3,5-tris(10methylethyl) with 2,6-diisoproyl diisocyanate, and the like. Such materials are commercially sold under the tradenames: STABAXOL 1, STABAXOL P, STABAXOL P-100, STABAXOL KE7646, (Rhein-Chemie, of Rheinau GmbH, Germany and Bayer). Carbodiimides are taught as polyester hydrolysis stabilization additives in U.S. Pat. Nos. 3,193,522, 3,193,523, 3,975,329, 5,169,499, 5,169,711, 5,246,992, 5,378,537, 5,464,890, 5,686,552, 5,763,538, 5,885,709, and 5,886,088. These references are herewith incorporated into the present invention by reference.

Specific examples of epoxides may be selected from the group consisting of iso-nonyl-glycidyl ether, stearyl glycidyl ether, tricyclodecylmethylene glycidyl ether, phenyl glycidyl ether, p-tert.-butylphenyl glycidyl ether, o-decylphenyl glycidyl ether, allyl glycidyl ether, butyl glycidyl ether, lauryl glycidyl ether, benzyl glycidyl ether, cyclohexyl glycidyl ether, alpha-cresyl glycidyl ether, decyl glycidyl ether, dodecyl glycidyl ether, N-(epoxyethyl)succinimide, N-(2,3-epoxypropyl)phthalimide, and the like. Catalysts may be included to increase the rate of reaction, for example, alkali metal salts. Epoxides are taught as polyester hydrolysis stabilization additives in U.S. Pat. Nos. 3,627,867, 3,657,191, 3,869,427, 4,016,142, 4,071,504, 4,139,521, 4,144,285, 4,374,960, 4,520,174, 4,520,175, 5 5,763,538, and 5,886,088. These references are herewith incorporated into the present invention by reference.

Specific examples of cyclic carbonates may be selected from the group consisting of ethylene carbonate, methyl ethylene carbonate, 1,1,2,2-tetramethyl ethylene carbonate, 1,2-diphenyl ethylene carbonate, ant the like. Cyclic carbonates, such as ethylene carbonate, are disclosed as hydrolysis stabilization additives in U.S. Pat. Nos. 3,657,191, 4,374,960, and 4,374,961. These references are herewith incorporated into the present invention by reference.

Preferably, the hydrolysis stabilization additive is selected from the group consisting of carbodiimides.

The amount of hydrolysis stabilization additive required to lower the carboxyl concentration of the polyester during its conversion to monofilaments is dependent on the carboxyl content of the polyester prior to extrusion into monofilaments. In general, the amount of hydrolysis stabilization additive used will range from 0.1 to 10.0 weight percent based on the polyester. Preferably the amount of the hydrolysis stabilization additive used is in the range of 0.2 to 4.0 weight percent.

The hydrolysis stabilization additive may be incorporated within the branched poly(ethylene terephthalate)s of the present invention through a separate melt compounding process utilizing any known intensive mixing process, such as extrusion through a single screw or twin screw extruder, through intimate mixing with the solid granular material, such as mixing, stirring or pellet blending operations, or through cofeeding within the monofilament process.

The hydrolytically stabilized, branched poly(ethylene terephthalate)s of the present invention may incorporate additives, fillers, or other materials commonly taught within the art. Said additives may include thermal stabilizers, antioxidants, UV absorbers, UV stabilizers, processing aides, waxes, lubricants, color stabilizers, and the like. Said fillers may include calcium carbonate, glass, kaolin, talc, clay, carbon black, and the like. Said other materials may include nucleants, pigments, dyes, delusterants, such as titanium dioxide and zinc sulfide, antiblocks, such as silica, antistats, flame retardants, brighteners, silicon nitride, metal ion sequestrants, anti-staining agents, silicone oil, surfactants, soil repellants, modifiers, viscosity modifiers, zirconium acid, reinforcing fibers, and the like. These additives, fillers, and other materials may be incorporated within the branched poly(ethylene terephthalate)s of the present invention through a separate melt compounding process utilizing any known intensive mixing process, such as extrusion, through intimate mixing with the solid granular material, such as pellet blending, or through cofeeding within the monofilament process.

The hydrolytically stabilized, branched poly(ethylene terephthalate)s of the present invention may be blended with other polymers commonly taught within the art. Said other polymers may include polyolefins, such as polyethylene, polypropylene, polybutene, poly-4-methyl pentene, polystyrene, and the like, cyclic olefin polymers, modified polyolefins, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, thermoplastic polyurethanes, polyvinyl chloride, polyvinlidene chloride copolymers, liquid crystalline polymers, fluorinated polymers, such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and the like and combinations thereof. Polyester monofilaments which incorporate thermoplastic polyurethanes are taught in U.S. Pat. Nos. 5,169,711 and 5,652,057, said references are hereby incorporated in the present invention by reference. Polyester monofilaments which incorporate polyphenylene sulfide are taught in U.S. Pat. Nos. 5,218,043, 5,424,125, and 5,456,973, said references are incorporated in the present invention by reference. Polyester monofilaments which incorporate fluoropolymers are taught in U.S. Pat. Nos. 5,283,110, 5,297,590, 5,378,537, 5,407,736, 5,460,869, 5,472,780, 5,489,467, and 5,514,472, said references are incorporated in the present invention by reference. Polyester monofilaments which incorporate non-fluorine containing polymers are taught within U.S. Pat. No. 5,686,552, said reference which is hereby incorporated into the present invention by reference. Polyester monofilaments which incorporate liquid crystalline polymers are taught in U.S. Pat. No. 5,692,938, said reference which is hereby incorporated into the present invention by reference.

These other polymers may be incorporated within the branched poly(ethylene terephthalate)s of the present invention through a separate melt compounding process utilizing any known intensive mixing process, such as extrusion through a single or twin screw extruder, through intimate mixing with the solid granular material, such as mixing, stirring or pellet blending operations, or through cofeeding within the monofilament process.

The hydrolytically stabilized, branched poly(ethylene terephthalate)s of the present invention may be formed into monofilaments by methods known with in the art, for example, as taught in U.S. Pat. Nos. 3,051,212, 3,999,910, 4,024,698, 4,030,651, 4,072,457, and 4,072,663, which are herein incorporated into the present invention by reference. As one skilled in the art would appreciate, the process may be tailored to take into account the exact material to be formed into monofilaments, to take into account the desired physical and chemical properties desired in the monofilament and the like. The exact determination of the spinning parameters for achieving a certain combination of monofilament properties can be routinely carried out by determining the dependence of the contemplated monofilament property on the composition for the polyester and on the spinning parameters.

The branched poly(ethylene terephthalate)s of the present invention are preferably dried prior to their formation into monofilaments. In general, the branched poly(ethylene terephthalate)s of the present invention are melted at a temperature in the range of about 265 to about 300° C.

Preferably, the polyesters of the present invention are melted in the temperature range of about 265 to about 290° C. The spinning may generally be carried out by means of a spinning grid or an extruder. The extruder melts the dried granular polyester of the present invention and conveys the melt to the spinning aggregate by means of a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester may be filtered through, for example, screen filters, to remove any particulate foreign matter. The molten polyester may then be conveyed, optionally through a metering pump, through a die to form the monofilament. After exiting the die, the monofilaments may be quenched in an air or a water bath to form solid filaments. The monofilament may optionally be spin finished. These as made filaments may be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The finished cooled monofilaments may then be wound up onto spools. This should not be considered limiting. The hydrolytically stabilized, branched poly(ethylene terephthalate)s of the present invention may be formed into the shape of monofilaments by any known process to produce monofilaments.

In order to provide the desired tenacity, the filaments prepared from the branched poly(ethylene terephthalate)s of the present invention may be drawn at least about 2:1. Preferably the filaments of the present invention may be drawn at least about 4:1. The overall draw ratio may be varied to allow for the production of a range of denier of the monofilaments.

Typical ranges of sizes of monofilaments used in press fabrics and dryer fabrics are 0.20 mm to 1.27 mm in diameter or the equivalent mass in cross-section in other cross-section shapes, such as square or oval. For forming fabrics, finer monofilaments are used, for example, as small as 0.05 mm to about 0.9 mm in diameter. Most often, the monofilaments used in forming fabrics have a diameter between about 0.12 mm to about 0.4 mm. On the other hand, for special industrial applications, monofilaments of 3.8 mm in diameter or greater may be desired.

The monofilament of the present invention may take any cross-sectional shape, for example, as a circle, flattened figure, square, triangle, pentagon, polygons, multifoil, dumbbell, cocoon, and the like. When this monofilament is intended as a warp in a papermaking drier canvas, the monofilament having the cross-sectional shape of a flattened figure is preferably used to improve the level of proof against staining and ensuring a flatness of the produced drier canvas. The term "flattened figure" as used herein refers to an ellipse or a rectangle. The term not only embraces a geometrically defined exact ellipse and rectangle but also shapes roughly similar to an ellipse and a rectangle and includes a shape obtained by rounding the four corners of a rectangle.

Fabrics of monofilaments may be formed into dryer screen fabrics by weaving the monofilament in both the machine and cross-machine directions.

A further aspect of the present invention is blends of branched poly(ethylene terephthalate)s with other linear polyesters shaped in the form of monofilaments. Said other linear polyesters may be produced from dicarboxylic acids and glycols.

Said other linear polyesters are comprised essentially of 50.0 mole percent of a dicarboxylic acid, and 50 mole percent of a diol.

Said dicarboxylic acid component is meant to include unsubstituted and substituted aromatic, aliphatic, unsaturated, and alicyclic dicarboxylic acids and the lower alkyl esters of dicarboxylic acids having from 2 carbons to 36 carbons. Specific examples of the desirable dicarboxylic acid component include terephthalic acid, dimethyl terephthalate, isophthalic acid, dimethyl isophthalate, 2,6-napthalene dicarboxylic acid, dimethyl-2,6-naphthalate, 2,7-naphthalenedicarboxylic acid, dimethyl-2,7-naphthalate, 3,4'-diphenyl ether dicarboxylic acid, dimethyl-3,4'-diphenyl ether dicarboxylate, 4,4'-diphenyl ether dicarboxylic acid, dimethyl-4,4'-diphenyl ether dicarboxylate, 3,4'-diphenyl sulfide dicarboxylic acid, dimethyl-3,4'-diphenyl sulfide dicarboxylate, 4,4'-diphenyl sulfide dicarboxylic acid, dimethyl4,4'-diphenyl sulfide dicarboxylate, 3,4'-diphenyl sulfone dicarboxylic acid, dimethyl-3,4'-diphenyl sulfone dicarboxylate, 4,4'-diphenyl sulfone dicarboxylic acid, dimethyl4,4'-diphenyl sulfone dicarboxylate, 3,4'-benzophenonedicarboxylic acid, dimethyl-3,4'-benzophenonedicarboxylate, 4,4'-benzophenonedicarboxylic acid, dimethyl-4,4'-benzophenonedicarboxylate, 1,4-naphthalene dicarboxylic acid, dimethyl-1,4-naphthalate, 4,4'-methylene bis(benzoic acid), dimethyl-4,4'-methylenebis(benzoate), oxalic acid, dimethyl oxalate, malonic acid, dimethyl malonate, succinic acid, dimethyl succinate, methylsuccinc acid, glutaric acid, dimethyl glutarate, 2-methylglutaric acid, 3-methylglutaric acid, adipic acid, dimethyl adipate, 3-methyladipic acid, 2,2,5,5-tetramethylhexanedioic acid, pimelic acid, suberic acid, azelaic acid, dimethyl azelate, sebacic acid, 1,11-undecanedicarboxylic acid, 1,10-decanedicarboxylic acid, undecanedioic acid, 1,12-dodecanedicarboxylic acid, hexadecanedioic acid, docosanedioic acid, tetracosanedioic acid, dimer acid, 1,4-cyclohexanedicarboxylic acid, dimethyl-1,4-cyclohexanedicarboxylate, 1,3-cyclohexanedicarboxylic acid, dimethyl-1,3-cyclohexanedicarboxylate, 1,1-cyclohexanediacetic acid, metal salts of 5-sulfodimethylisophalate, fumaric acid, maleic anhydride, maleic acid, hexahydrophthalic acid phthalic acid and the like and mixtures derived therefrom. This should not be considered limiting. Essentially any dicarboxylic acid known within the art may find utility within the present invention.

Said diol component is meant to include unsubstituted, substituted, straight chain, branched, cyclic aliphatic, aliphatic-aromatic or aromatic diols having from 2 carbon atoms to 36 carbon atoms and poly(alkylene ether) glycols with molecular weights between about 250 to 4000. Specific examples of the desirable diol component include ethylene glycol, 1,3-propanediol, 1,4-butanediol, 1,6-hexanediol, 1,8-octanediol, 1,10-decanediol, 1,12-dodecanediol, 1,14-tetradecanediol, 1,16-hexadecanediol, dimer diol, 4,8-bis(hydroxymethyl)-tricyclo[5.2.1.0/2.6]decane, 1,4-cyclohexanedimethanol, di(ethylene glycol), tri(ethylene glycol), poly(ethylene ether) glycols, poly(butylene ether) glycols and the like and mixtures derived therefrom. This should not be taken as limiting. Essentially any diol known within the art may find use within the present invention.

The other linear polyester component of the present invention needs to have an inherent viscosity, which is an indicator of molecular weight, of at least equal to or greater than 0.30. More desirably, the inherent viscosity (IV) of said other polyesters will be at least equal to 0.50 dL/g, as measured on a 0.5 percent (weight/volume) solution of the polyester in a 50:50 (weight) solution of trifluoroacetic acid:dichloromethane solvent system at room temperature. These inherent viscosities will be sufficient to produce the polyester blends of the present invention for monofilaments. Higher inherent viscosities may be desirable. The polymerization conditions may be adjusted to obtain the desired inherent viscosities up to at least about 0.5 and desirably higher than 0.65 dL/g. Further processing of the polyester may achieve inherent viscosities of 0.7, 0.8, 0.9, 1.0, 1.5, 2.0 dL/g and even higher.

The other linear polyester component of the present invention should have an inherent viscosity in the range of about 0.30 to about 1.20 dL/g. Preferably, the other linear polyester component of the present invention should have an inherent viscosity in the range of about 0.50 to about 1.00 dL/g. More preferably, the other linear polyester component of the present invention should have an inherent viscosity in the range of about 0.60 to about 0.95 dL/g.

The other linear polyesters of the present invention may be prepared by conventional polycondensation techniques. The product compositions may vary somewhat based on the method of preparation used, particularly in the amount of diol that is present within the polymer. These methods include the reaction of the diol monomers with acid chlorides. For example, acid chlorides of the dicarboxylic acid component may be combined with the diol component in a solvent, such as toluene, in the presence of a base, is such as pyridine, which neutralizes the hydrochloric acid as it is produced. Such procedures are known. See, for example, R. Storbeck, et. al., in J. Appl. Polymer Science, Vol. 59, pp.1199–1202 (1996). Other well known variations using acids chlorides may also be used, such as the interfacial polymerization method, or the monomers may simply be stirred together while heating.

When the polymer is made using acid chlorides, the ratio of the monomer units in the product polymer is about the same as the ratio of reacting monomers. Therefore, the ratio of monomers charged to the reactor is about the same as the desired ratio in the product. A stoichiometric equivalent of the diol components and the diacid components generally will be used to obtain a high molecular weight polymer.

Preferably, the other polyesters of the present invention will be produced through a melt polymerization method. In the melt polymerization method, the dicarboxylic acid component, (either as acids, esters, or mixtures thereof) and the diol component are combined in the presence of a catalyst to a high enough temperature that the monomers combine to form esters and diesters, then oligomers, and finally polymers. The polymeric product at the end of the polymerization process is a molten product. Generally, the diol component is volatile and distills from the reactor as the polymerization proceeds. Such procedures are known. See, for example, U.S. Pat. Nos. 3,563,942, 3,948,859, 4,094,721, 4,104,262, 4,166,895, 4,252,940, 4,390,687, 4,419,507, 4,585,687, 5,053,482, 5,292,783, 5,446,079, 5,480,962, and 6,063,464 and the references cited therein, which are herein incorporated by reference The melt process conditions of the present invention, particularly the amounts of monomers used, depend on the polymer composition that is desired. The amount of the diol component and the dicarboxylic acid component are desirably chosen so that the final polymeric product contains the desired amounts of the various monomer units, desirably with equimolar amounts of monomer units derived from the respective diol and diacid components. Because of the volatility of some of the monomers, especially some of the diol components, and depending on such variables as whether the reactor is sealed, (i.e., is under pressure), the polymerization temperature ramp rate, and the efficiency of the distillation columns used in synthesizing the polymer, some of the monomers may need to be included in excess at the beginning of the polymerization reaction and removed by distillation as the reaction proceeds. This is particularly true of the diol component.

The exact amount of monomers to be charged to a particular reactor is readily determined by a skilled practitioner, but often will be in the ranges below. Excesses of the diacid and diol are often desirably charged, and the excess diacid and diol is desirably removed by distillation or other means of evaporation as the polymerization reaction proceeds. The diol component is desirably charged at a level 0 to 100 percent greater than the desired incorporation level in the final product. For examples of the diol component which are volatile under the polymerization conditions, such as ethylene glycol, 1,3-propanediol, or 1,4-butanediol, 30 to 100 percent excesses are desirably charged. For less volatile examples of the diol component, such as dimer diol, no excesses need be desirably charged.

The ranges given for the monomers are very wide because of the wide variation in the monomer loss during polymerization, depending on the efficiency of distillation columns and other kinds of recovery and recycle systems and the like, and are only an approximation. Exact amounts of monomers that are charged to a specific reactor to achieve a specific composition are readily determined by a skilled practitioner.

In the polymerization process, the monomers are combined, and are heated gradually with mixing with a catalyst or catalyst mixture to a temperature in the range of 230° C. to about 300° C., desirably 250° C. to 295° C. The exact conditions and the catalysts depend on whether the diacids are polymerized as true acids or as dimethyl esters. The catalyst may be included initially with the reactants, and/or may be added one or more times to the mixture as it is heated. The catalyst used may be modified as the reaction proceeds. The heating and stirring are continued for a sufficient time and to a sufficient temperature, generally with removal by distillation of excess reactants, to yield a molten polymer having a high enough molecular weight to be suitable for the present invention.

Catalysts that may be used include salts of Li, Ca, Mg, Mn, Zn, Pb, Sb, Sn, Ge, and Ti, such as acetate salts and oxides, including glycol adducts, and Ti alkoxides. These are generally known in the art, and the specific catalyst or combination or sequence of catalysts used may be readily selected by a skilled practitioner. The preferred catalyst and preferred conditions differ depending on, for example, whether the diacid monomer is polymerized as the free diacid or as a dimethyl ester and the exact chemical identity of the diol component.

Polymers can be made by the melt condensation process above having adequate inherent viscosity for the present invention. Solid state polymerization may be used to achieve even higher inherent viscosities (molecular weights).

The product made by melt polymerization, after extruding, cooling and pelletizing, may be essentially noncrystalline. Noncrystalline material can be made semicrystalline by heating it to a temperature above the glass transition temperature for an extended period of time. This induces crystallization so that the product can then be heated to a higher temperature to raise the molecular weight.

The polymer may also be crystallized prior to solid state polymerization by treatment with a relatively poor solvent for polyesters which induces crystallization. Such solvents reduce the glass transition temperature (Tg) allowing for crystallization. Solvent induced crystallization is known for polyesters and is described in U.S. Pat. Nos. 5,164,478 and 3,684,766, which are incorporated herein by reference.

The semicrystalline polymer is subjected to solid state polymerization by placing the pelletized or pulverized polymer into a stream of an inert gas, usually nitrogen, or under a vacuum of 1 Torr, at an elevated temperature, but below the melting temperature of the polymer for an extended period of time.

The blends of the branched poly(ethylene terephthalate)s with the other linear polyesters of the present invention are comprised essentially of about 95 to 5 weight percent of said branched poly(ethylene terephthalate)s and about 5 to 95 weight percent of said other linear polyester, based on the total amount of polyester. Preferably, the blends of the branched poly(ethylene terephthalate)s with the other linear polyesters of the present invention are comprised essentially of about 90 to 10 weight percent of said branched poly (ethylene terephthalate)s and about 10 to 90 weight percent of said other linear polyester, based on the total amount of polyester.

The other linear polyester may be incorporated within the branched poly(ethylene terephthalate)s of the present invention through a separate melt compounding process utilizing any known intensive mixing process, such as extrusion through a single screw or twin screw extruder, through intimate mixing with the solid granular material, such as mixing, stirring or pellet blending operations, or through cofeeding within the monofilament process.

The blends of the branched poly(ethylene terephthalate)s and the other linear polyester of the present invention may incorporate additives, fillers, or other materials commonly taught within the art. Said additives may include thermal stabilizers, antioxidants, UV absorbers, UV stabilizers, processing aides, waxes, lubricants, color stabilizers, and the like. Said fillers may include calcium carbonate, glass, kaolin, talc, clay, carbon black, and the like. Said other materials may include nucleants, pigments, dyes, delusterants, such as titanium dioxide and zinc sulfide, antiblocks, such as silica, antistats, flame retardants, brighteners, silicon nitride, metal ion sequestrants, antistaining agents, silicone oil, surfactants, soil repellants, modifiers, viscosity modifiers, zirconium acid, reinforcing fibers, and the like. These additives, fillers, and other materials may be incorporated within the blend of the branched poly(ethylene terephthalate)s and the other linear polyester of the present invention through a separate melt compounding process utilizing any known intensive mixing process, such as extrusion, through intimate mixing with the solid granular material, such as pellet blending, or through cofeeding within the monofilament process.

The blends of the branched poly(ethylene terephthalate)s and the other linear polyester of the present invention may be blended with other polymers commonly taught within the art. Said other polymers may include polyolefins, such as polyethylene, polypropylene, polybutene, poly-4-methyl pentene, polystyrene, and the like, cyclic olefin polymers, modified polyolefins, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, thermoplastic polyurethanes, polyvinyl chloride, polyvinlidene chloride copolymers, liquid crystalline polymers, fluorinated polymers, such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and the like and combinations thereof.

Polyester monofilaments which incorporate thermoplastic polyurethanes are taught in U.S. Pat. Nos. 5,169,711 and 5,652,057, said references are hereby incorporated in the present invention by reference. Polyester monofilaments which incorporate polyphenylene sulfide are taught in U.S. Pat. Nos. 5,218,043, 5,424,125, and 5,456,973, said references are incorporated in the present invention by reference. Polyester monofilaments which incorporate fluoropolymers are taught in U.S. Pat. Nos. 5,283,110, 5,297,590, 5,378,537, 5,407,736, 5,460,869, 5,472,780, 5,489,467, and 5,514,472, said references are incorporated in the present invention by reference. Polyester monofilaments which incorporate non-fluorine containing polymers are taught within U.S. Pat. No. 5,686,552, said reference which is hereby incorporated into the present invention by reference. Polyester monofilaments which incorporate liquid crystalline polymers are taught in U.S. Pat. No. 5,692,938, said reference which is hereby incorporated into the present invention by reference.

These other polymers may be incorporated within the blend of the branched poly(ethylene terephthalate)s and the other linear polyester of the present invention through a separate melt compounding process utilizing any known intensive mixing process, such as extrusion through a single or twin screw extruder, through intimate mixing with the solid granular material, such as mixing, stirring or pellet blending operations, or through cofeeding within the monofilament process.

The blend of the branched poly(ethylene terephthalate)s and the other linear polyester of the present invention may be formed into monofilaments by methods known within the art, for example, as taught in U.S. Pat. Nos. 3,051,212, 3,999,910, 4,024,698, 4,030,651, 4,072,457, and 4,072,663, which are herein incorporated into the present invention by reference. Specifically, polyester-polyester blends have been formed into the shape of monofilaments in the art, as taught in U.S. Pat. Nos. 5,464,890 and 5,648,152, said references which are herein incorporated within the present invention by reference. As one skilled in the art would appreciate, the process may be tailored to take into account the exact material to be formed into monofilaments, to take into account the desired physical and chemical properties desired in the monofilament and the like. The exact determination of the spinning parameters for achieving a certain combination of monofilament properties can be routinely carried out by determining the dependence of the contemplated monofilament property on the composition for the polyester and on the spinning parameters.

The blend of the branched poly(ethylene terephthalate)s and the other linear polyester of the present invention are preferably dried prior to their formation into monofilaments. In general, the blend of the branched poly(ethylene terephthalate)s and the other linear polyester of the present invention are melted at a temperature in the range of about 265 to about 300° C. Preferably, the polyester blends of the present invention are melted in the temperature range of about 265 to about 290° C. The spinning may generally be carried out by means of a spinning grid or an extruder. The extruder melts the dried granular polyester of the present invention and conveys the melt to the spinning aggregate by means of a screw. It is well known that polyesters will tend to thermally degrade based on time and temperature in the melt. It is preferred that the time that the polyester blend is in the melt is minimized through use of the shortest length of pipes between the melting of the polyester blend and the spinneret. The molten polyester blend may be filtered through, for example, screen filters, to remove any particulate foreign matter. The molten polyester blend may then be conveyed, optionally through a metering pump, through a die to form the monofilament. After exiting the die, the monofilaments may be quenched in an air or a water bath to form solid filaments. The monofilament may optionally be spin finished. These as made filaments may be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The finished cooled monofilaments may then be wound up onto spools. This should not be considered limiting. The blend of the branched poly(ethylene terephthalate)s and the other linear polyester of the present invention may be formed into the shape of monofilaments by any known process to produce monofilaments.

In order to provide the desired tenacity, the filaments prepared from the blend of the branched poly(ethylene terephthalate)s and the other linear polyester of the present invention may be drawn at least about 2:1. Preferably the filaments of the present invention may be drawn at least about 4:1. The overall draw ratio may be varied to allow for the production of a range of denier of the monofilaments.

Typical ranges of sizes of monofilaments used in press fabrics and dryer fabrics are 0.20 mm to 1.27 mm in diameter or the equivalent mass in cross-section in other cross-section shapes, such as square or oval. For forming fabrics, finer monofilaments are used, for example, as small as 0.05 mm to about 0.9 mm in diameter. Most often, the monofilaments used in forming fabrics have a diameter between about 0.12 mm to about 0.4 mm. On the other hand, for special industrial applications, monofilaments of 3.8 mm in diameter or greater may be desired.

The monofilament of the present invention may take any cross-sectional shape, for example, as a circle, flattened figure, square, triangle, pentagon, polygons, multifoil, dumbbell, cocoon, and the like. When this monofilament is intended as a warp in a papermaking drier canvas, the monofilament having the cross-sectional shape of a flattened figure is preferably used to improve the level of proof against staining and ensuring a flatness of the produced drier canvas. The term "flattened figure" as used herein refers to an ellipse or a rectangle. The term not only embraces a geometrically defined exact ellipse and rectangle but also shapes roughly similar to an ellipse and a rectangle and includes a shape obtained by rounding the four corners of a rectangle.

Fabrics of monofilaments may be formed into dryer screen fabrics by weaving the monofilament in both the machine and cross-machine directions.

A further aspect of the present invention is blends of branched poly(ethylene terephthalate)s with other linear polyesters stabilized with an effective amount of hydrolysis stabilization additive shaped in the form of monofilaments.

The hydrolysis stabilization additive may be any known material in the art which enhances the stability of the polyester blend monofilament to hydrolytic degradation. Examples of said hydrolysis stabilization additive may include: diazomethane, carbodiimides, epoxides, cyclic carbonates, oxazolines, aziridines, keteneimines, isocyanates, alkoxy end-capped polyalkylene glycols, and the like. This should not be considered limiting. Essentially any material which increases the hydrolytic stability of the monofilaments formed from the blend of the branched poly(ethylene terephthalate)s with the other linear polyester of the present invention would find utility as a hydrolysis stabilization additive in the present invention.

Specific examples of carbodiimides may be selected from the group consisting of N,N'-di-o-tolylcarbodiimide, N,N'-diphenylcarbodiimide, N,N'dioctyldecylcarbodiimide, N,N'-di-2,6-dimethylphenylcarbodiimide, N-tolyl-N'cyclohexylcarbodiimide, N,N'-di-2,6-diisopropylphenylcarbodiimide, N,N'di-2,6-di-tert-butylphenylcarbodiimide, N-tolyl-N'-phenylcarbodiimide, N,N'-di-p-nitrophenylcarbodiimide, N,N'di-p-aminophenylcarbodiimide, N,N'di-p-hydroxyphenylcarbodiimide, N,N'-di-cyclohexylcarbodiimide, N,N'-di-p-tolylcarbodiimide, p-phenylene-bis-di-o-tolylcarbodiimide, p-phenylene-bisdicyclohexylcarbodiimide, hexamethylene-bisdicyclohexylcarbodiimide, ethylene-bisdiphenylcarbodiimide, benzene-2,4-diisocyanato-1,3,5-tris(1-methylethyl) homopolymer, a copolymer of 2,4-diisocyanato-1,3,5-tris(10methylethyl) with 2,6-diisoproyl diisocyanate, and the like. Such materials are commercially sold under the tradenames: STABAXOL 1, STABAXOL P, STABAXOL P-100, STABAXOL KE7646, (Rhein-Chemie, of Rheinau GmbH, Germany and Bayer). Carbodiimides are taught as polyester hydrolysis stabilization additives in U.S. Pat. Nos. 3,193,522, 3,193,523, 3,975,329, 5,169,499, 5,169,711, 5,246,992, 5,378,537, 5,464,890, 5,686,552, 5,763,538, 5,885,709 and 5,886,088. These references are herewith incorporated into the present invention by reference.

Specific examples of epoxides may be selected from the group consisting of iso-nonyl-glycidyl ether, stearyl glycidyl ether, tricyclodecylmethylene glycidyl ether, phenyl glycidyl ether, p-tert.-butylphenyl glycidyl ether, o-decylphenyl glycidyl ether, allyl glycidyl ether, butyl glycidyl ether, lauryl glycidyl ether, benzyl glycidyl ether, cyclohexyl glycidyl ether, alpha-cresyl glycidyl ether, decyl glycidyl ether, dodecyl glycidyl ether, N-(epoxyethyl)succinimide, N-(2,3-epoxypropyl)phthalimide, and the like.

Catalysts may be included to increase the rate of reaction, for example, alkali metal salts. Epoxides are taught as polyester hydrolysis stabilization additives in U.S. Pat. Nos. 3,627,867, 3,657,191, 3,869,427, 4,016,142, 4,071,504, 4,139,521, 4,144,285, 4,374,960, 4,520,174, 4,520,175, 5,763,538, and 5,886,088. These references are herewith incorporated into the present invention by reference.

Specific examples of cyclic carbonates may be selected from the group consisting of ethylene carbonate, methyl ethylene carbonate, 1,1,2,2-tetramethyl ethylene carbonate, 1,2-diphenyl ethylene carbonate, ant the like. Cyclic carbonates, such as ethylene carbonate, are disclosed as hydrolysis stabilization additives in U.S. Pat. Nos. 3,657,191, 4,374,960, and 4,374,961. These references are herewith incorporated into the present invention by reference.

Preferably, the hydrolysis stabilization additive is selected from the group consisting of carbodiimides.

The amount of hydrolysis stabilization additive required to lower the carboxyl concentration of the polyester blend during its conversion to monofilaments is dependent on the carboxyl content of the polyester prior to extrusion into monofilaments. In general, the amount of hydrolysis stabilization additive used will range from 0.1 to 10.0 weight percent based on the polyester blend. Preferably the amount of the hydrolysis stabilization additive used is in the range of 0.2 to 4.0 weight percent.

The hydrolysis stabilization additive may be incorporated within the blend of the branched poly(ethylene terephthalate)s and the other linear polyester of the present invention through a separate melt compounding process utilizing any known intensive mixing process, such as extrusion through a single screw or twin screw extruder, through intimate mixing with the solid granular material, such as mixing, stirring or pellet blending operations, or through cofeeding within the monofilament process.

The hydrolytically stabilized blend of the branched poly (ethylene terephthalate)s and the other linear polyester of the present invention may incorporate additives, fillers, or other materials commonly taught within the art. Said additives may include thermal stabilizers, antioxidants, UV absorbers, UV stabilizers, processing aides, waxes, lubricants, color stabilizers, and the like. Said fillers may include calcium carbonate, glass, kaolin, talc, clay, carbon black, and the like. Said other materials may include nucleants, pigments, dyes, delusterants, such as titanium dioxide and zinc sulfide, antiblocks, such as silica, antistats, flame retardants, brighteners, silicon nitride, metal ion sequestrants, anti-staining agents, silicone oil, surfactants, soil repellants, modifiers, viscosity modifiers, zirconium acid, reinforcing fibers, and the like. These additives, fillers, and other materials may be incorporated within the hydrolytically stabilized blend of the branched poly(ethylene terephthalate)s and the other linear polyester of the present invention through a separate melt compounding process utilizing any known intensive mixing process, such as extrusion, through intimate mixing with the solid granular material, such as pellet blending, or through cofeeding within the monofilament process.

The hydrolytically stabilized blend of the branched poly (ethylene terephthalate)s and the other linear polyester of the present invention may be blended with other polymers commonly taught within the art. Said other polymers may include polyolefins, such as polyethylene, polypropylene, polybutene, poly-4-methyl pentene, polystyrene, and the like, cyclic olefin polymers, modified polyolefins, such as copolymers of various alpha-olefins, glycidyl esters of unsaturated acids, ionomers, ethylene/vinyl copolymers such as ethylene/vinyl chloride copolymers, ethylene/vinyl acetate copolymers, ethylene/acrylic acid copolymers, ethylene/methacrylic acid copolymers and the like, thermoplastic polyurethanes, polyvinyl chloride, polyvinlidene chloride copolymers, liquid crystalline polymers, fluorinated polymers, such as polytetrafluoroethylene, ethylene tetrafluoroethylene copolymers, tetrafluoroethylene hexafluoropropylene copolymers, polyfluoroalkoxy copolymers, polyvinylidene fluoride, polyvinylidene copolymers, ethylene chlorotrifluoroethylene copolymers, and the like, polyamides, such as Nylon-6, Nylon-66, Nylon 69, Nylon 610, Nylon 611, Nylon 612, Nylon 11, Nylon 12, and copolymers and the like, polyimides, polyphenylene sulfide, polyphenylene oxide, polysulfones, polyethersulfones, rubbers, polycarbonate, polyacrylates, terpene resins, polyacetal, styrene/acrylonitrile copolymers, styrene/maleic anhydride copolymers, styrene/maleimide copolymers, coumarone/indene copolymers, and the like and combinations thereof. Polyester monofilaments which incorporate thermoplastic polyurethanes are taught in U.S. Pat. Nos. 5,169,711 and 5,652,057, said references are hereby incorporated in the present invention by reference. Polyester monofilaments which incorporate polyphenylene sulfide are taught in U.S. Pat. Nos. 5,218,043, 5,424,125, and 5,456,973, said references are incorporated in the present invention by reference. Polyester monofilaments which incorporate fluoropolymers are taught in U.S. Pat. Nos. 5,283,110, 5,297,590, 5,378,537, 5,407,736, 5,460,869, 5,472,780, 5,489,467, and 5,514,472, said references are incorporated in the present invention by reference. Polyester monofilaments which incorporate nonfluorine containing polymers are taught within U.S. Pat. No. 5,686,552, said reference which is hereby incorporated into the present invention by reference. Polyester monofilaments which incorporate liquid crystalline polymers are taught in U.S. Pat. No. 5,692,938, said reference which is hereby incorporated into the present invention by reference.

These other polymers may be incorporated within the blend of the branched poly(ethylene terephthalate)s and the other linear polyester of the present invention through a separate melt compounding process utilizing any known intensive mixing process, such as extrusion through a single or twin screw extruder, through intimate mixing with the solid granular material, such as mixing, stirring or pellet blending operations, or through cofeeding within the monofilament process.

The hydrolytically stabilized blend of the branched poly (ethylene terephthalate)s and the other linear polyester of the present invention may be formed into monofilaments by methods known within the art, for example, as taught in U.S. Pat. Nos. 3,051,212, 3,999,910, 4,024,698, 4,030,651, 4,072,457, and 4,072,663, which are herein incorporated into the present invention by reference. As one skilled in the art would appreciate, the process may be tailored to take into account the exact material to be formed into monofilaments, to take into account the desired physical and chemical properties desired in the monofilament and the like. The exact determination of the spinning parameters for achieving a certain combination of monofilament properties can be routinely carried out by determining the dependence of the contemplated monofilament property on the composition for the polyester blend and on the spinning parameters.

The blend of the branched poly(ethylene terephthalate)s and the other linear polyester of the present invention are preferably dried prior to their formation into monofilaments. In general, the blend of the branched poly(ethylene terephthalate)s and the other linear polyester of the present invention are melted at a temperature in the range of about 265 to about 300° C. Preferably, the polyester blends of the present invention are melted in the temperature range of about 265 to about 290° C. The spinning may generally be carried out by means of a spinning grid or an extruder. The extruder melts the dried granular polyester of the present invention and conveys the melt to the spinning aggregate by means of a screw. It is well known that polyesters will tend to thermally degrade based on time and temperature in the melt. It is preferred that the time that the polyester is in the melt is minimized through use of the shortest length of pipes between the melting of the polyester and the spinneret. The molten polyester blend may be filtered through, for example, screen filters, to remove any particulate foreign matter. The molten polyester blend may then be conveyed, optionally through a metering pump, through a die to form the monofilament. After exiting the die, the monofilaments may be quenched in an air or a water bath to form solid filaments. The monofilament may optionally be spin finished. These as made filaments may be drawn at elevated temperatures up to 100° C. between a set of draw rolls to a draw ratio of from 3.0:1 to 4.5:1, and optionally be further drawn at a higher temperature of up to 250° C. to a maximum draw ratio of 6.5:1 and allowed to relax up to about 30 percent maximum while heated in a relaxing stage. The finished cooled monofilaments may then be wound up onto spools. This should not be considered limiting. The hydrolytically stabilized, blend of the branched poly(ethylene terephthalate)s and the other linear polyester of the present invention may be formed into the shape of monofilaments by any known process to produce monofilaments.

In order to provide the desired tenacity, the filaments prepared from the hydrolytically stabilized blend of the branched poly(ethylene terephthalate)s and the other linear polyester of the present invention may be drawn at least about 2:1. Preferably the filaments of the present invention may be drawn at least about 4:1. The overall draw ratio may be varied to allow for the production of a range of denier of the monofilaments.

Typical ranges of sizes of monofilaments used in press fabrics and dryer fabrics are 0.20 mm to 1.27 mm in diameter or the equivalent mass in cross-section in other cross-section shapes, such as square or oval. For forming fabrics, finer monofilaments are used, for example, as small as 0.05 mm to about 0.9 mm in diameter. Most often, the monofilaments used in forming fabrics have a diameter between about 0.12 mm to about 0.4 mm.

On the other hand, for special industrial applications, monofilaments of 3.8 mm in diameter or greater may be desired.

The monofilament of the present invention may take any cross-sectional shape, for example, as a circle, flattened figure, square, triangle, pentagon, polygons, multifoil, dumbbell, cocoon, and the like. When this monofilament is intended as a warp in a papermaking drier canvas, the monofilament having the cross-sectional shape of a flattened figure is preferably used to improve the level of proof against staining and ensuring a flatness of the produced drier canvas. The term "flattened figure" as used herein refers to an ellipse or a rectangle. The term not only embraces a geometrically defined exact ellipse and rectangle but also shapes roughly similar to an ellipse and a rectangle and includes a shape obtained by rounding the four corners of a rectangle.

Fabrics of monofilaments may be formed into dryer screen fabrics by weaving the monofilament in both the machine and cross-machine directions.

The monofilaments of the present invention will find utility a reinforcements for rubbers, fishing lines, toothbrush bristles, paint brush bristles and the like. When woven into fabrics, the monofilaments of the present invention will find utility as industrial belts and paper machine clothing.

EXAMPLES AND COMPARATIVE EXAMPLES

Test Methods

Inherent Viscosity (IV) is defined in "Preparative Methods of Polymer Chemistry", W. R. Sorenson and T. W. Campbell, 1961, p. 35. It is determined at a concentration of 0.5 g./100 mL of a 50:50 weight percent trifluoroacetic acid:dichloromethane acid solvent system at room temperature by a Goodyear R-103B method.

Preparative Example PE 1

To a 200 gallon autoclave is charged dimethyl terephthalate, (126.16 pounds), ethylene glycol, (78.0 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Preparative Example PE 2

To a 200 gallon autoclave is charged dimethyl terephthalate, (126.16 pounds), trimellitic anhydride, (1,2, 4-benzenetricarboxylic anhydride), (0.0936 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Preparative Example PE 3

A portion of the material produced in Preparative Example 1 is subjected to solid phase polymerization at a temperature of 230° C. until the polymer is tested for inherent viscosity, as described above and is found to have an IV of 0.72 dL/g.

Comparative Example CE 1

The polyester produced in Preparative Example PE 1 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

Example 1

The polyester produced in Preparative Example PE 2 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Comparative Example CE 2

The polyester produced in Preparative Example PE 3 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have comparable tensile strength to that measured for the monofilaments produced within Example 1.

This Comparative Example demonstrates that monofilaments with comparable physical properties may be produced from the branched polyesters of the present invention without the added solid phase polymerization processing.

Preparative Example PE 4

To a 200 gallon autoclave is charged dimethyl terephthalate, (126.16 pounds), trimellitic anhydride, (1,2, 4-benzenetricarboxylic anhydride), (0.1872 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.65 dL/g.

Example 2

The polyester produced in Preparative Example PE 4 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 5

To a 200 gallon autoclave is charged dimethyl terephthalate, (126.16 pounds), trimellitic anhydride, (1,2, 4-benzenetricarboxylic anhydride), (0.2808 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.62 dL/g.

Example 3

The polyester produced in Preparative Example PE 5 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 6

To a 200 gallon autoclave is charged dimethyl terephthalate, (126.16 pounds), trimellitic anhydride, (1,2, 4-benzenetricarboxylic anhydride), (0.3744 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.60 dL/g.

Example 4

The polyester produced in Preparative Example PE 6 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 7

To a 200 gallon autoclave is charged dimethyl terephthalate, (126.16 pounds), trimellitic anhydride, (1,2,4-benzenetricarboxylic anhydride), (0.4680 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Example 5

The polyester produced in Preparative Example PE 7 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example 1.

Preparative Example PE 8

To a 200 gallon autoclave is charged dimethyl terephthalate, (126.16 pounds), pyromellitic dianhydride, (1,2,4,5-benzenetetracarboxylic dianhydride), (0.0624 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Example 6

The polyester produced in Preparative Example PE 8 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 9

To a 200 gallon autoclave is charged dimethyl terephthalate, (126.16 pounds), pyromellitic dianhydride, (1,2,4,5-benzenetetracarboxylic dianhydride), (0.1247 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Example 7

The polyester produced in Preparative Example PE 9 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 10

To a 200 gallon autoclave is charged dimethyl terephthalate, (126.16 pounds), pentaerythritol, (0.0624 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Example 8

The polyester produced in Preparative Example PE 10 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Preparative Example PE 11

To a 200 gallon autoclave is charged dimethyl terephthalate, (126.16 pounds), pentaerythritol, (0.1247 pounds), ethylene glycol, (73.4 pounds), manganese(II) acetate tetrahydrate, (37.65 grams), and antimony(III) trioxide, (13.6 grams). The autoclave is purged three times with nitrogen and heated to 245° C. over 4.5 hours with stirring. Over this heating cycle, over 20,000 grams of distillate is recovered. With continued heating and stirring, vacuum is staged onto the autoclave over 1.5 hours. The resulting reaction mixture is stirred at 275° C. under full vacuum, (pressure equal to or less than 2 mm Hg), for 4 hours. The vacuum is then released and the resulting reaction mixture is extruded out of the autoclave as a ribbon, the polymer ribbon is cooled and chopped.

The polymer is tested for inherent viscosity, as described above and is found to have an IV of 0.67 dL/g.

Example 9

The polyester produced in Preparative Example PE 11 is dried at 160° C. for at least 6 hours. The dried polyester is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 10

The polyester produced in Preparative Example PE 2 is dried at 160° C. for at least 6 hours. The dried polyester is then placed in an extruder hopper and extruded. N,N'-di-2,6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 1.

Example 11

The polyester produced in Preparative Example PE 4 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 2.

Example 12

The polyester produced in Preparative Example PE 5 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 3.

Example 13

The polyester produced in Preparative Example PE 6 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 4.

Example 14

The polyester produced in Preparative Example PE 7 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 5.

Example 15

The polyester produced in Preparative Example PE 8 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 6.

Example 16

The polyester produced in Preparative Example PE 9 is dried at 160° C. for at least 6 hours. The dried polyester is then placed in an extruder hopper and extruded. N,N'-di-2, 6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 7.

Example 17

The polyester produced in Preparative Example PE 10 is dried at 160° C. for at least 6 hours. The dried polyester is then placed in an extruder hopper and extruded. N,N'-di-2,6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 8.

Example 18

The polyester produced in Preparative Example PE 11 is dried at 160° C. for at least 6 hours. The dried polyester is then placed in an extruder hopper and extruded. N,N'-di-2,6-diisopropylphenylcarbodiimide was melted at 80° C. and pumped into the extruder feed throat at a rate of 1.5 weight percent based on the total blend (polyester and carbodiimide). The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

The as produced monofilaments are found to retain fifty percent of the initial strength in saturated steam at a temperature of 121° C. for at least 10 percent longer than found for the monofilaments produced within Example 9.

Example 19

The polyesters produced in Preparative Example PE 2 and Preparative Example PE 3 are dried at 160° C. for at least 6 hours. These polyesters are pellet blended to form a blend comprising 50 weight percent of the material from Preparative Example PE 2 and 50 weight percent of the material from Preparative Example PE 3. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

Example 20

The polyesters produced in Preparative Example PE 1 and Preparative Example PE 4 are dried at 160° C. for at least 6 hours. These polyesters are pellet blended to form a blend comprising 50 weight percent of the material from Preparative Example PE 1 and 50 weight percent of the material from Preparative Example PE 4. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C.

with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 21

The polyesters produced in Preparative Example PE 1 and Preparative Example PE 5 are dried at 160° C. for at least 6 hours. These polyesters are pellet blended to form a blend comprising 75 weight percent of the material from Preparative Example PE 1 and 25 weight percent of the material from Preparative Example PE 5. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 22

The polyesters produced in Preparative Example PE 1 and Preparative Example PE 6 are dried at 160° C. for at least 6 hours. These polyesters are pellet blended to form a blend comprising 75 weight percent of the material from Preparative Example PE 1 and 25 weight percent of the material from Preparative Example PE 6. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 23

The polyesters produced in Preparative Example PE 1 and Preparative Example PE 7 are dried at 160° C. for at least 6 hours. These polyesters are pellet blended to form a blend comprising 75 weight percent of the material from Preparative Example PE 1 and 25 weight percent of the material from Preparative Example PE 7. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 24

The polyesters produced in Preparative Example PE 1 and Preparative Example PE 8 are dried at 160° C. for at least 6 hours. These polyesters are pellet blended to form a blend comprising 25 weight percent of the material from Preparative Example PE 1 and 75 weight percent of the material from Preparative Example PE 8. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 25

The polyesters produced in Preparative Example PE 3 and Preparative Example PE 9 are dried at 160° C. for at least 6 hours. These polyesters are pellet blended to form a blend comprising 50 weight percent of the material from Preparative Example PE 3 and 50 weight percent of the material from Preparative Example PE 9. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 975° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

Example 26

The polyesters produced in Preparative Example PE 1 and Preparative Example PE 10 are dried at 160° C. for at least 6 hours. These polyesters are pellet blended to form a blend comprising 25 weight percent of the material from Preparative Example PE 1 and 75 weight percent of the material from Preparative Example PE 10. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 27

The polyesters produced in Preparative Example PE 1 and Preparative Example PE 11 are dried at 160° C. for at least 6 hours. These polyesters are pellet blended to form a blend comprising 50 weight percent of the material from Preparative Example PE 1 and 50 weight percent of the material from Preparative Example PE 11. The as made pellet blend was then mixed through tumbling. The dried polyester pellet blend is then placed in an extruder hopper and extruded. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to have at least 5 percent greater tensile strength than measured for the monofilaments produced within Comparative Example CE 1.

Example 28

The polyesters produced in Preparative Example PE 2 and Preparative Example PE 3 are dried at 160° C. for at least 6 hours. These polyesters are pellet blended to form a blend comprising 50 weight percent of the material from Preparative Example PE 2 and 50 weight percent of the material from Preparative Example PE 3. The as made pellet blend was then mixed through tumbling. The dried polyester pellet blend is then placed in an extruder hopper and extruded. N,N'-di-2,6diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 19.

Example 29

The polyesters produced in Preparative Example PE 1 and Preparative Example PE 4 are dried at 160° C. for at least 6 hours. These polyesters are pellet blended to form a blend comprising 50 weight percent of the material from Preparative Example PE 1 and 50 weight percent of the material from Preparative Example PE 4. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 20.

Example 30

The polyesters produced in Preparative Example PE 1 and Preparative Example PE 5 are dried at 160° C. for at least 6 hours. These polyesters are pellet blended to form a blend comprising 75 weight percent of the material from Preparative Example PE 1 and 25 weight percent of the material from Preparative Example PE 5. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 21.

Example 31

The polyesters produced in Preparative Example PE 1 and Preparative Example PE 6 are dried at 160° C. for at least 6 hours. These polyesters are pellet blended to form a blend comprising 75 weight percent of the material from Preparative Example PE 1 and 25 weight percent of the material from Preparative Example PE 6. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 22.

Example 32

The polyesters produced in Preparative Example PE 1 and Preparative Example PE 7 are dried at 160° C. for at least 6 hours. These polyesters are pellet blended to form a blend comprising 75 weight percent of the material from Preparative Example PE 1 and 25 weight percent of the material from Preparative Example PE 7. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 23.

Example 33

The polyesters produced in Preparative Example PE 1 and Preparative Example PE 8 are dried at 160° C. for at least 6 hours. These polyesters are pellet blended to form a blend comprising 25 weight percent of the material from Preparative Example PE 1 and 75 weight percent of the material from Preparative Example PE 8. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 24.

Example 34

The polyesters produced in Preparative Example PE 3 and Preparative Example PE 9 are dried at 160° C. for at least 6 hours. These polyesters are pellet blended to form a blend comprising 50 weight percent of the material from Preparative Example PE 3 and 50 weight percent of the material from Preparative Example PE 9. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 25.

Example 35

The polyesters produced in Preparative Example PE 1 and Preparative Example PE 10 are dried at 160° C. for at least 6 hours. These polyesters are pellet blended to form a blend comprising 25 weight percent of the material from Preparative Example PE 1 and 75 weight percent of the material from Preparative Example PE 10. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 26.

Example 36

The polyesters produced in Preparative Example PE 1 and Preparative Example PE 11 are dried at 160° C. for at least 6 hours. These polyesters are pellet blended to form a blend comprising 50 weight percent of the material from Preparative Example PE 1 and 50 weight percent of the material from Preparative Example PE 11. The as made pellet blend was then mixed through tumbling. The dried polyester pellet blend is then placed in an extruder hopper and extruded. N,N'-di-2,6-diisopropylphenylcarbodiimide was melted at 80° C. and pumped into the extruder feed throat at a rate of 1.5 weight percent based on the total blend. The extrusion conditions, which are not considered limiting, are:

First Heater Zone Temperature: 260° C.

Second Heater Zone Temperature: 275° C.

Third Heater Zone Temperature: 275° C.

Extruder Die Temperature: 285° C.

The extruder die had eight 0.80 mm holes. The final monofilament size was 0.30 mm. The monofilament was quenched in a water bath at a temperature of 66° C., positioned 2.0 cm under the die. The quenched monofilament is drawn in a hot air oven at a temperature of 74° C. with a draw ratio of 3.36, drawn further in a hot air oven at a temperature of 230° C. to a total draw ratio of 5.0 and allowed to relax 25 percent at a temperature of 200° C. The finished monofilament is then taken up on spools for testing.

The resulting monofilament is tested on an Instron tensile testing machine for tenacity, break elongation and initial modulus.

The monofilament is then exposed to saturated steam at a temperature of 121° C. and a pressure of about 15 psig. for various trial periods after which the tensile properties are measured. The time in hours to the point where the residual strength is fifty percent of the initial strength is determined.

The as produced monofilaments are found to retain fifty percent of the initial strength in saturated steam at a temperature of 121° C. for at least 10 percent longer than found for the monofilaments produced within Example 27.

It is to be understood that the above described embodiments are illustrative only and that modification throughout may occur to one skilled in the art. Accordingly, this invention is not to be regarded as limited to the embodiments disclosed herein.

What is claimed is:

1. A monofilament comprising a branched poly(ethylene terephthalate) having an inherent viscosity of at least 0.50 dL/g.

2. The monofilament of claim 1 wherein said inherent viscosity is at least 0.60 dL/g.

3. The monofilament of claim 1 wherein said inherent viscosity is 0.50 to 0.70 dL/g.

4. The monofilament of claim 1 that is hydrolytically stabilized by a hydrolysis stabilization additive.

5. The monofilament of claim 4 wherein said hydrolysis stabilization additive comprises a carbodiimide.

6. The monofilament of claim 1 that further comprises a polymer that is blended with said branched poly(ethylene terephthalate).

7. The monofilament of claim 6 that is hydrolytically stabilized by a hydrolysis stabilization additive.

8. The monofilament of claim 1 that further comprises a linear polyester that is blended with said branched poly (ethylene terephthalate).

9. The monofilament of claim 8 wherein said linear polyester comprises a dicarboxylic acid component and a diol component.

10. The monofilament of claim 8 wherein said linear polyester has an inherent viscosity of at least 0.30 dL/g.

11. The monofilament of claim 8 that is hydrolytically stabilized by a hydrolysis stabilization additive.

12. The monofilament of claim 8 wherein said linear polyester and said branched poly(ethylene terephthalate) are further blended with a polymer.

13. The monofilament of claim 12 that is hydrolytically stabilized by a hydrolysis stabilization additive.

14. A process for forming a monofilament, said process comprising:

(a) forming a branched poly(ethylene terephthalate) having an inherent viscosity of at least 0.50 dL/g; and (b) shaping said branched poly(ethylene terephthalate) to form said monofilament.

15. The process of claim 14 wherein said step (a) comprises polymerizing terephthalic acid or a lower ester of terephthalic acid in the presence of a composition comprising a polyfunctional branching agent to form said branched poly(ethylene terephthalate) having said inherent viscosity of at least 0.50 dL/g.

16. The process of claim 15 wherein said polyfunctional branching agent comprises three or more carboxylic acid functions, hydroxy functions, or a mixture thereof.

17. The process of claim 15 wherein said composition further comprises a dicarboxylic acid component and a diol component.

18. The process of claim 17 wherein said dicarboxylic acid component comprises an unsubstituted or substituted aromatic, aliphatic, unsaturated, or alicyclic dicarboxylic acid or a lower alkyl ester of a dicarboxylic acid having from 2 carbon atoms to 36 carbon atoms.

19. The process of claim 17 wherein said diol component comprises an unsubstituted, substituted, straight chain, branched, cyclic aliphatic, aliphatic-aromatic, or aromatic diol having from 2 carbon atoms to 36 carbon atoms, or a poly(alkylene ether) glycol having a molecular weight of 250 to 4000.

20. The process of claim 15 wherein said polymerizing is a polycondensation or a melt polymerization.

21. The process of claim 14 wherein said inherent viscosity is at least 0.60 dL/g.

22. The process of claim 14 wherein said inherent viscosity is 0.50 to 0.70 dL/g.

23. A monofilament prepared by a process comprising:

(a) forming a branched poly(ethylene terephthalate) having an inherent viscosity of at least 0.50 dL/g; and (b) shaping said branched poly(ethylene terephthalate) to form said monofilament.

* * * * *